US005240236A

United States Patent [19]

Mierau

[11] Patent Number: 5,240,236

[45] Date of Patent: Aug. 31, 1993

[54] STRAP CLAMP

[75] Inventor: Cameron D. Mierau, Vancouver, Canada

[73] Assignee: Cae Machinery Ltd., Vancouver, Canada

[21] Appl. No.: 758,539

[22] Filed: Sep. 9, 1991

Related U.S. Application Data

[63] Continuation of Ser. No. 590,996, Oct. 1, 1990, abandoned.

[51] Int. Cl.[5] ..... B27B 1/00

[52] U.S. Cl. ..... 269/131

[58] Field of Search ..... 269/108, 130–132, 269/296; 254/47; 144/379, 366, 193 R

[56] References Cited

U.S. PATENT DOCUMENTS

| | | | |
|---|---|---|---|
| 3,830,466 | 8/1974 | Rasmussen et al. | 254/47 |
| 4,047,710 | 9/1977 | Wilson | 269/108 |
| 4,188,878 | 2/1980 | Kuhnau | 269/131 |
| 4,681,146 | 7/1987 | Liska et al. . | |
| 4,756,351 | 7/1988 | Knutsen | 269/130 |
| 4,865,094 | 9/1989 | Stroud et al. . | |

FOREIGN PATENT DOCUMENTS

| | | |
|---|---|---|
| 2080191A | 2/1982 | United Kingdom . |
| 2170146A | 7/1986 | United Kingdom . |

OTHER PUBLICATIONS

UK Search Report for Application No. 9120287.9, dated 22 Jan. 1992.

*Primary Examiner*—Robert C. Watson

*Attorney, Agent, or Firm*—Townsend and Townsend Khourie and Crew

[57] ABSTRACT

A clamp comprising first and second spaced supports on either side of a clamping surface and a flexible strap having first and second ends extending between the spaced supports. A carriage system is provided to allow the flexible strap to be moved toward or away from the clamping surface to engage and clamp articles between the flexible strap and the clamping surface. The flexible strap forms about the articles to be clamped thereby ensuring a good clamping grip. The clamp is particularly suited for use in clamping logs in a delivery chute during processing operations.

10 Claims, 2 Drawing Sheets 40
10
22
45
29
37
20
27
15
34

STRAP CLAMP

This is a continuation of application Ser. No. 07/590,996, filed Oct. 1, 1990, now abandoned.

FIELD OF THE INVENTION

This invention relates to a clamp for engaging and holding down articles using a flexible strap member, and is particularly suited as, but not limited to, a clamp for holding down cut logs in a delivery chute for processing by a flaker or like equipment.

BACKGROUND OF THE INVENTION

Processing of cut logs in the production of chips or flakes for flakeboard and the like often involves the delivery of batches of log to processing machinery. Often, the logs are converted to chips or flakes in sections that the machinery can conveniently handle. This generally involves advancing the logs in stages along a delivery chute into the processing machinery. The logs are advanced to protrude a portion of each log from the end of the delivery chute so that the log ends are exposed for processing by appropriate processing machinery. After each advance of the logs it is necessary to clamp and hold the logs in position while the processing machinery operates to remove the exposed portion of the logs.

Applicant's U.S. Pat. No. 4,865,094, issued Sep. 12, 1989 discloses a "Long Log Waferizer" that works in the above mentioned manner. U.S. Pat. No. 4,865,094 shows a log clamping system that relies on a series of vertically aligned bars to clamp and hold down logs in the delivery chute. With such a clamping arrangement, it is possible that short logs can pivot under the bars because there is only one point contact on the log. Therefore, the vertical bar arrangement is best suited for long logs 8 to 25 feet in length where the log length prevents the logs from pivoting.

On shorter logs less than 8 feet long, it has been determined that it is better to use an alternative clamping arrangement in which the logs are formed into a compact bundle against a clamping surface so that pivoting is prevented.

SUMMARY OF THE INVENTION

Accordingly there is a need for an improved clamping mechanism that can safely and securely hold a batch of logs of short length and different diameters to prevent log movement during processing. Any movement of the logs will result in a poorer quality of flakes being produced.

The present invention provides a clamp comprising:

first and second spaced supports on either side of a clamping surface;

flexible strap means having first and second ends and extending between said spaced supports; and means for moving said flexible strap means toward or away from said clamping surface to engage and clamp articles between said flexible strap and said clamping surface.

By using a flexible strap, the clamp of the present invention can form itself about any batch of logs to be clamped in the delivery chute to compress the logs into a compact group against a clamping surface thereby greatly reducing any movement and pivoting. In addition, the clamp is relatively simple in structure and operation. The flexible strap is easily and cheaply replaced as it becomes worn.

BRIEF DESCRIPTION OF THE DRAWINGS

Aspects of the present invention are illustrated, merely by way of example, in the accompanying drawings in which.

DESCRIPTION OF THE PREFERRED EMBODIMENT

Figure 1:
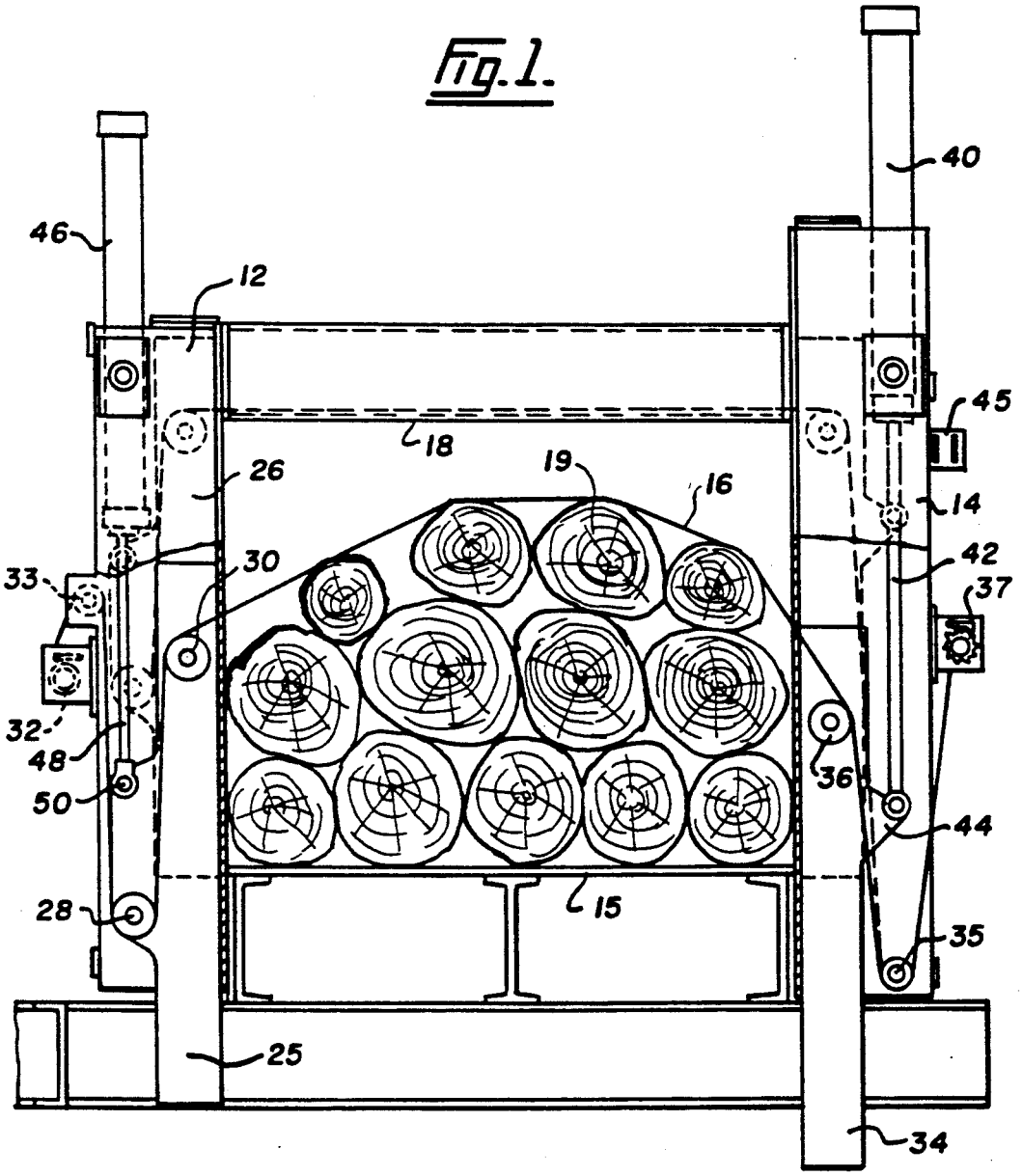
FIG. 1 is a front elevation view of the strap clamp of the present invention showing a preferred embodiment with broken away sections.

In the figures, there is shown a preferred embodiment of the strap clamp 10 of the present invention. The clamp comprises first and second spaced supports in the form of vertical support frames 12 and 14 mounted on either side of a clamping surface 15. In this case, clamping surface 15 is the base of a log delivery chute commonly used with flaking or chipping machinery. Flexible strap means in the form of flexible strap 16 extend between frames 12 and 14. Strap 16 may be formed from nylon webbing. Means are provided for moving the flexible strap between an upper position, shown by dashed lines 18, downwardly toward clamping surface 15 to the clamping position shown at 16. It is desirable that the clamping surface be in the form of a U-shaped channel having side walls to contain the logs as they are compressed together. In the clamping position illustrated, strap 16 is tightened and formed about a batch of logs 19 to securely hold the logs in place between the strap and the clamping surface. Alternatively, this arrangement can be considered as a means for adjusting the effective length of the flexible strap to tighten the strap about the logs.

Figure 2:
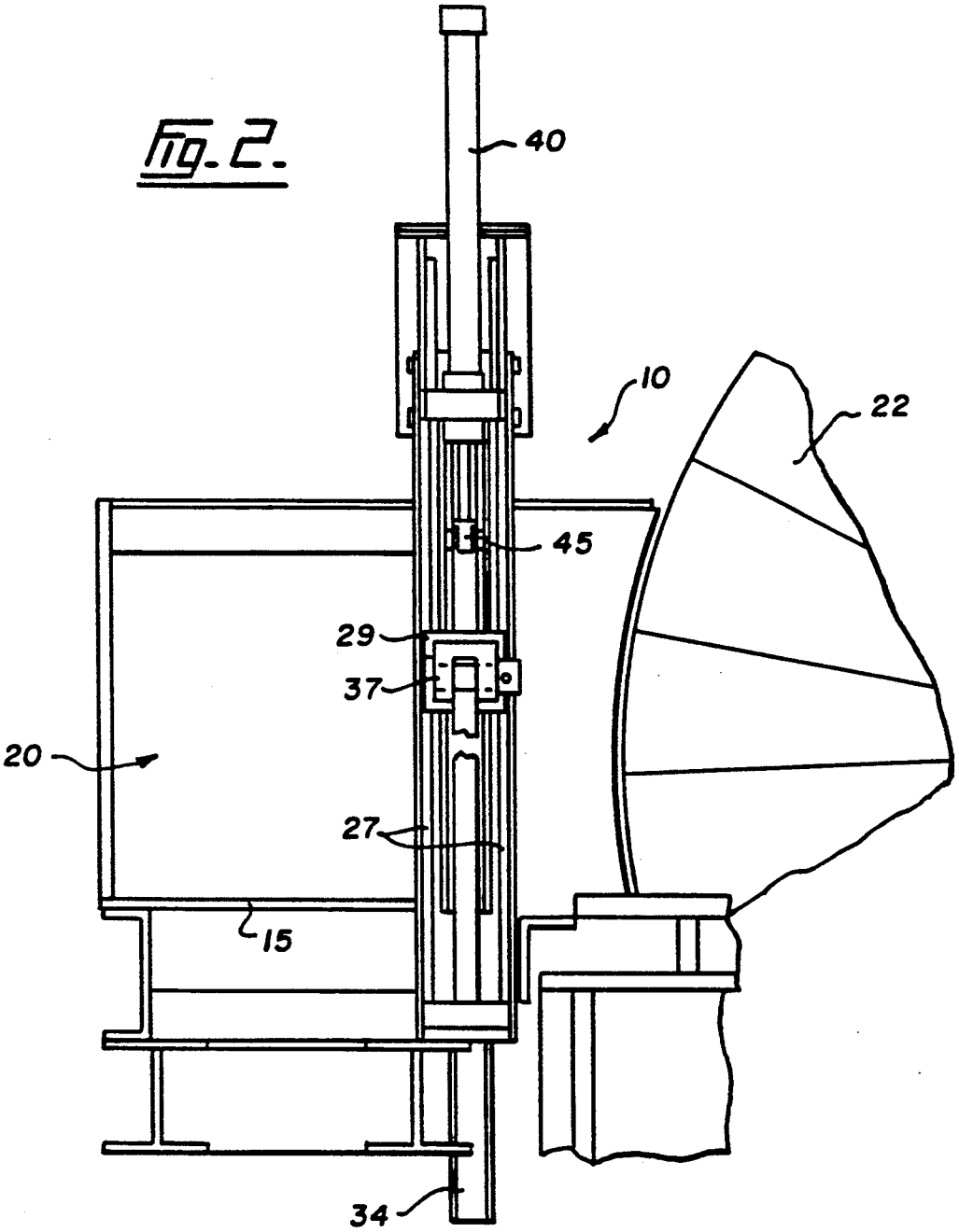
FIG. 2 is a side elevation view showing the strap clamp in position in a log delivery chute adjacent a waferizing disc.

FIG. 2 illustrates the positioning of a clamp according to the present invention at the end of a log delivery chute 20. The clamp is positioned adjacent a rotatable waferizing disc 22 that is movable across the end of the delivery chute to process the protruding ends of the clamped logs.

FIG. 1 provides a detailed view of the preferred embodiment of the strap clamp of the present invention. In FIG. 1, sections of support frames 12 and 14 are broken away to show internal detail. As best shown in FIG. 2, each support frame is formed from a pair of plates 27 joined by bracing pieces 29 to define an interior cavity. The interior of first support frame 12 houses means for moving flexible strap 16 comprising a carriage member 25 adapted for slidable movement inside the frame. Rails 26 are provided in the frame interior and define a track in which carriage member 25 moves. There are slide members (not shown) on carriage member 25 adapted to engage in the track. Carriage member 25 is equipped with a tension roller 28 and a guide roller 30, both of which are rotatably attached. Flexible strap 16 passes over guide roller 30, extends downwardly to tension roller 28, loops around the underside of tension roller 28, over roller 33 and then is anchored to first support frame 12. In the illustrated embodiment, the anchor point is a winch assembly 32 about which the end of flexible strap 16 can be wound to allow for easy removal of the strap. Guide roller 33 over which strap 16 passes is mounted on the support frame 12. From carriage member 25, strap 16 extends across the open space of delivery chute 20 to second support frame 14.

On the opposite side of the delivery chute, second support frame 14 has a similar hollow structure housing means for taking up excess slack in flexible strap 16 comprising an additional carriage member 34 fitted with a single guide roller 36 over which the flexible strap passes. The second end of flexible strap 16 is removably attached to support frame 14 at winch assembly 37. Guide roller 35 is provided on frame member 14 under which strap 16 is passed on its way to the winching assembly. The use of winching assemblies to anchor the ends of the flexible strap allow for quick and easy changes of the strap in the event it becomes worn or breaks.

Biasing means in the form of pneumatic cylinder 40 is provided to ensure that carriage member 34 always tends to be biased upwardly away from clamping surface 15. The piston rod 42 of pneumatic cylinder 40 is attached to flange 44 of carriage member 34. This arrangement ensures that any excess slack in strap 16 is taken up by roller 36 as carriage member 34 is always tending to move upwardly against the downward force exerted by flexible strap 16. A proximity switch 45 is mounted adjacent the lower end of pneumatic cylinder 40 to detect the position of the piston rod 42. If the switch detects that rod 42 is fully retracted indicating that strap 16 is broken or badly stretched, the clamp apparatus can be shut down to repair or replace the strap.

The movement of carriage member 25 which controls the clamping and releasing action of the clamp is controlled by hydraulic cylinder 46. Piston rod 48 is extendable from cylinder 46 and is attached to carriage member 25 at joint 50.

The strap clamp of the present invention is used in the following manner:

In its unclamped position, the strap clamp of the present invention is retracted to the raised position indicated by dashed lines in FIG. 1. Hydraulic cylinder piston rod 48 is retracted to its upper position to move carriage member 25 upwardly. Flexible strap 16 is anchored at its first and second ends at winch assemblies 32 and 37 and the movement of the strap over the various guiding rollers and tension roller 28 causes flexible strap to occupy the configuration indicated by dashed line 18. Pneumatic cylinder 40 moves carriage member 34 upwardly to take up any excess slack in the belt. In this configuration, flexible strap 16 is raised out of the delivery chute so that it does not impede the movement of logs being pushed along the chute.

Once the logs 14 have been pushed along the chute and into position for further processing, the strap clamp is activated to move downwardly and clamp the logs into place in the delivery chute while processing takes place. This clamping action is accomplished by powering piston rod 48 of hydraulic cylinder 46 downwardly to cause carriage member 25 to move downwardly. Strap 16 looped beneath roller 28 is caused to move downwardly. As the flexible strap engages the uppermost logs 14, it automatically shapes about the logs to ensure a firm clamping grip. The logs are compressed downwardly into a compacted pile. The side walls 60 of the delivery chute prevent the logs from scattering as they are compressed.

A stretch sensor or similar device can be incorporated into the flexible strap to determine when sufficient clamping force is being exerted. Alternatively, a sensor can be provided to sense and control the hydraulic pressure in cylinder 46.

When strap 16 is moved downwardly, carriage member 34 follows the strap's downward movement in response to the downward force exerted by strap 16 engaging on the top periphery of roller 36. Pneumatic cylinder 40 supplies a constant upward force on carriage member 34 to ensure that any slack in the strap is taken up.

The protruding portion of the clamped logs are processed and the clamped logs released by raising the strap clamp. The above described cycle is then repeated.

At certain times, it is necessary to replace flexible strap 16 due to wear. This task is easily accomplished by extending piston rod 42 of pneumatic cylinder 40 with hydraulic cylinder piston rod 48 retracted. This creates sufficient slack in the strap to allow it to be easily removed from about winch assemblies 32 and 37. In an alternative arrangement, winch assemblies 32 and 37 can be replace by hook anchors and strap 16 can be formed with eyes at each end to engage the anchors.

Although the present invention has been described in some detail by way of example for purposes of clarity and understanding, it will be apparent that certain changes and modifications may be practised within the scope of the appended claims.

I claim:

1. A clamp comprising:

first and second spaced supports on either side of a clamping surface;

flexible strap means having first and second ends and extending between said spaced supports;

means for moving said flexible strap means comprising a carriage member adapted for slidable movement along a support member and a tension roller rotatably attached to said carriage member about which said flexible strap means is looped such that movement of said carriage member toward or away from said clamping surface along said support member acts to draw said strap means toward or away from said clamping surface to conform about and clamp articles between said flexible strap and said clamping surface.

2. A clamp as claimed in claim 1 in which said flexible strap means is releasably attached by said first and second ends to said first and second spaced supports, respectively.

3. A clamp as claimed in claim 1 including a guiding roller over which said flexible strap means passes on said carriage member.

4. A clamp as claimed in claim 1 in which movement of said carriage member along said support member is controlled by a hydraulic cylinder.

5. A clamp as claimed in claim 1 including means for taking up excess slack in said flexible strap means.

6. A clamp as claimed in claim 5 in which said means for taking up excess slack in said flexible strap means comprises:

an additional carriage member adapted for slidable movement on said second support member;

a roller rotatably mounted to said additional carriage member over which said flexible strap means passes; and biasing means acting on said additional carriage member to move said member away from said clamping surface to take up excess slack in said flexible strap means.

7. A clamp as claimed in claim 6 in which said biasing means comprises a pneumatic cylinder.

8. A clamp as claimed in claim 1 in which said flexible strap means is formed from nylon webbing.

9. A clamp as claimed in claim 2 in which said first and second spaced supports each have attached winch assemblies and the ends of said strap means are wound about said winch assemblies in order to anchor the ends of said straps to the spaced supports.

10. A clamp as claimed in claim 1 in which said clamping surface comprises the base and side walls of an essentially U-shaped log delivery chute.

* * * * *

UNITED STATES PATENT AND TRADEMARK OFFICE

CERTIFICATE OF CORRECTION

PATENT NO. : 5,240,236

DATED : August 31, 1993

INVENTOR(S) : Cameron D. Mierau and Douglas C. Beer

It is certified that error appears in the above-identified patent and that said Letters Patent is hereby corrected as shown below:

On the title page, item [75] Inventor:
Applicant requests the names of both inventors be listed on the above-identified patent.

Cameron D. Mierau
Douglas C. Beer

Signed and Sealed this

Seventeenth Day of May, 1994

Bruce Lehman

*Attest:*

BRUCE LEHMAN

*Attesting Officer*

*Commissioner of Patents and Trademarks*